US005214437A

United States Patent [19]

Hensler

[11] Patent Number: 5,214,437

[45] Date of Patent: May 25, 1993

[54] DRAGSTICK/ANTENNA

[76] Inventor: Scott E. Hensler, 1958 E. Concorda Dr., Tempe, Ariz. 85282

[21] Appl. No.: 732,726

[22] Filed: Jul. 18, 1991

Related U.S. Application Data

[63] Continuation of Ser. No. 511,343, Apr. 19, 1990, abandoned.

[51] Int. Cl.[5] ..... H01Q 1/00; H01Q 1/44; H01Q 9/30

[52] U.S. Cl. ..... 343/720; 343/749; 343/900

[58] Field of Search ..... 343/702, 703, 720, 718, 343/721, 825, 872, 894, 723, 901, 906, 749, 873, 895, 900; 455/66, 89, 344

[56] References Cited

U.S. PATENT DOCUMENTS

| | | | |
|---|---|---|---|
| 1,683,270 | 9/1928 | Taylor et al. | 343/894 |
| 2,367,196 | 1/1945 | Butler | 343/894 |
| 2,396,121 | 3/1946 | Patino | 343/901 |
| 2,927,995 | 3/1960 | Francis | 343/720 |
| 2,972,744 | 2/1961 | Rickards et al. | 343/873 |
| 3,474,453 | 10/1969 | Ireland | 343/750 |
| 4,057,757 | 11/1977 | Darden, Jr. | 455/89 |
| 4,121,218 | 10/1978 | Irwin et al. | 343/702 |
| 4,152,704 | 5/1979 | Burg | 343/720 |
| 4,300,140 | 11/1981 | Brandigampola | 343/900 |
| 4,915,670 | 4/1990 | Nesbit | 455/344 |

FOREIGN PATENT DOCUMENTS

| | | | |
|---|---|---|---|
| 0091076 | 6/1961 | Denmark | 343/900 |
| 0487453 | 12/1929 | Fed. Rep. of Germany | 343/720 |
| 1087190 | 8/1960 | Fed. Rep. of Germany | 343/900 |
| 0229356 | 2/1925 | United Kingdom | 343/720 |
| 0629092 | 9/1949 | United Kingdom | 343/900 |
| 0881758 | 11/1961 | United Kingdom | 343/900 |

*Primary Examiner*—Rolf Hille
*Assistant Examiner*—Peter Toby Brown
*Attorney, Agent, or Firm*—Harry M. Weiss

[57] ABSTRACT

An apparatus used in search and rescue operations that combines the features of a dragstick with the features of a radio antenna. The apparatus is comprised of an aluminum rod split into two, adjustably connected sections. At one end of the rod is a metal spike, The metal spike is used to make identifying marks in the ground thereby allowing the searcher to retrace his steps. At the other end of the rod is an electrical connector which allows the rod to be coupled to a standard two-way radio via coaxial cable. When current flows through the rod it acts like a half wavelength, omni-directional antenna. One of the two sections can be extended from or retracted into the other section, thereby varying the operating frequency of the rod when the rod operates as an antenna. An insulated grip allows the user to hold the rod while electrical current is flowing therethrough.

8 Claims, 3 Drawing Sheets

20
22
23
24
25
26
28
29
30
31
32
33
34
36
42
43
44
45
46
47
48
49
50
51
52
53
54
55
10
70
72

DRAGSTICK/ANTENNA

This is a continuation of application Ser. No. 07/511,343 filed on Apr. 19, 1990, now abandoned.

BACKGROUND OF THE INVENTION

1. Field of Invention

The subject invention relates generally to an apparatus and method therefor used in tracking animals or humans through remote terrain as in a search and rescue operation and in particular, to an apparatus and method therefor that combines the features of a dragstick for making identifying marks in the ground and an antenna through which radio signals can be broadcast and received.

2. Description of the Prior Art

Individuals attempting to track another person or an animal through remote and rugged terrain, as often occurs in search and rescue operations, confront two major problems. First, the searcher must be able to mark the trail he follows so that he will be able to retrace his steps. He also must be sure to distinguish his footprints from the lost person's footprints and other searcher's footprints. Presently, a device called a dragstick or sign cutting stick is used to overcome this problem. This dragstick is simply a wooden stick or pole having at one end a means for making an identifying mark in the ground. Second, the searcher must be able to send and receive communications from other searchers and a base camp. This is especially important when the person being sought is in need of immediate medical attention. Presently, standard, hand held radios employ a helical, omni-directional, ¼ wavelength vertical antenna generally referred to as rubber ducky antenna. These antennas have negative gain resulting in signals that tend to fade, especially when surrounded by hills or cliffs.

Francis, U.S. Pat. No. 2,927,995 discloses a fishing rod with a radio installed in the handle of the rod. The rod acts as an antenna. This rod, however, cannot function as a dragstick and the entire device disclosed by Francis is not structurally strong enough to be used in search and rescue operations. Furthermore, Francis is not pertinent art as a person skilled in the art of devices used in search and rescue operations would have no need to know about fishing rod technology.

Therefore there is a need for an antenna that would boost the power of the user's radio signal and could also be used as a dragstick.

SUMMARY OF THE INVENTION

An object of the subject invention is to provide an apparatus and method therefor that operates as both a dragstick and a radio antenna.

These and other objects, features and advantages will be apparent from the following description of the preferred embodiment of the invention and the accompanying drawings.

DESCRIPTION OF THE PREFERRED EMBODIMENT

Figure 1:
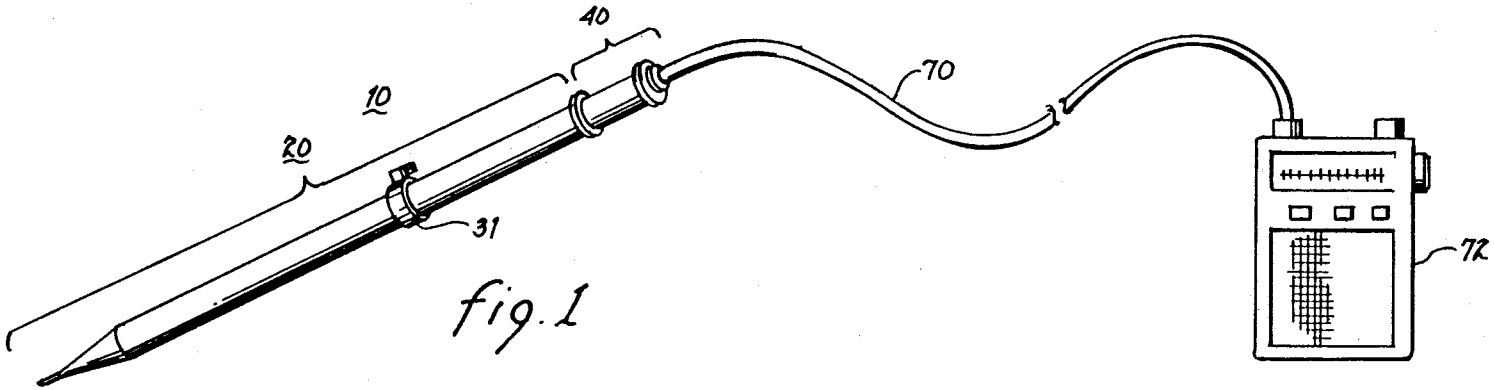
FIG. 1 is an illustration of a dragstick/antenna, according to the subject invention, coupled to a two-way radio.

As shown in FIG. 1, a dragstick/antenna or apparatus 10 is provided. A standard coaxial cable 70 couples the apparatus 10 to a commercially available two-way radio 72. The apparatus 10 is comprised of an antenna assembly 20 and a handle assembly 40.

Figure 2:
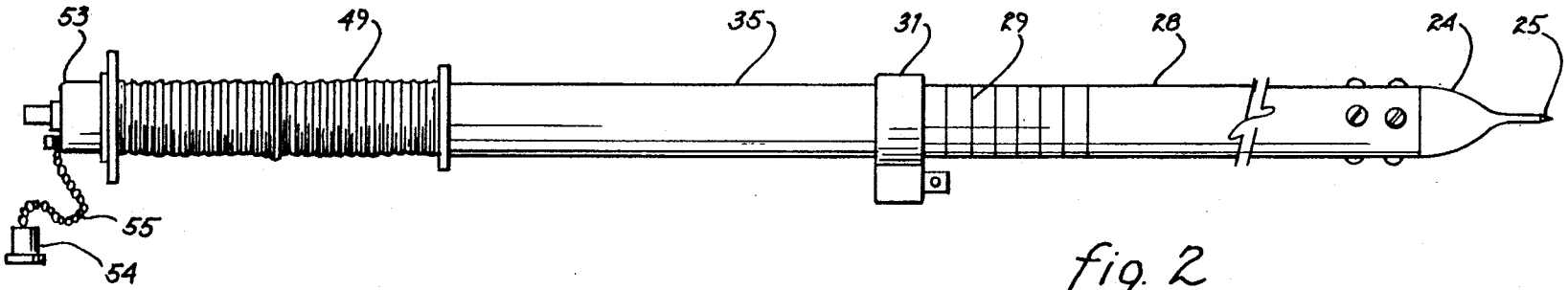
FIG. 2 is a side view of the dragstick/antenna of FIG. 1.
Figures 4, 5:
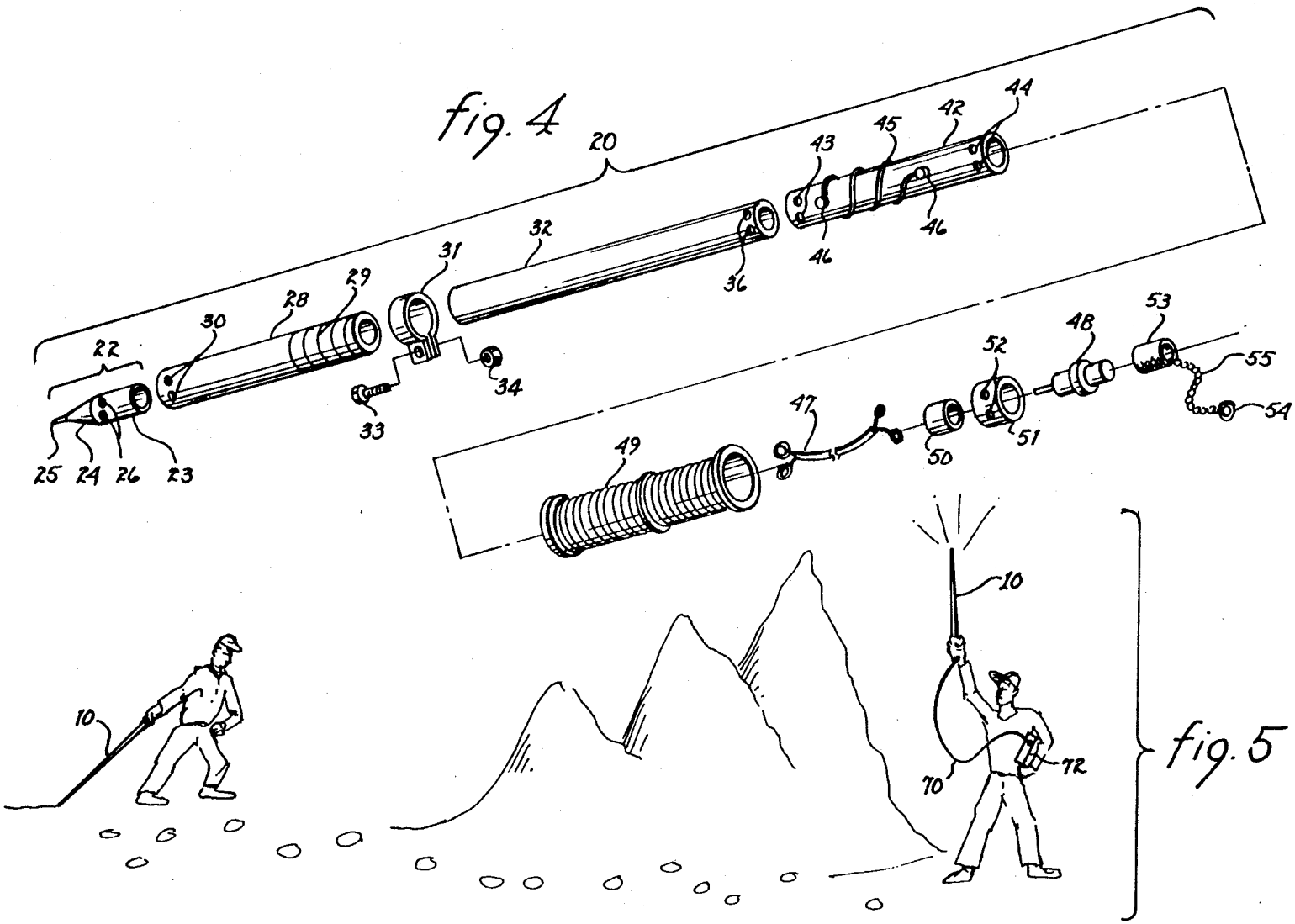
FIG. 4 is an exploded view of the dragstick/antenna of FIG. 1.
FIG. 5 is an illustration of the dragstick/antenna of FIG. 1 in use.

The antenna assembly 20 is comprised of a tip section 22, a tuning slide 28 and a bottom section 32 (see FIGS. 2 and 4).

Preferably, the tip section 22 is made of metal. The tip section 22 has a cylindrical base 23 which is sized to slide into the tuning slide 28 and a tapered head 24 with a spike 25 preferably having a diameter of about ½ inch extending therefrom. The cylindrical base 23 also has two threaded holes 26.

The tuning slide 28 is preferably made from aluminum tubing and is sized to slide into the bottom section 32. The tuning slide has two threaded holes 30 at one end for aligning with the holes 26. Two screws, not shown, are inserted through holes 30 and 26 thereby coupling the tip section 22 with the tuning slide 28. At the other end, the tuning slide 28 has a plurality of equally spaced, calibration steps 29. Each calibration step 29 corresponds to a specific operating frequency of the apparatus 10. By extending or retracting the tuning slide 28 until a specific calibration step 29 is positioned adjacent to a clamp ring 31,(described below), the user can pre-select the desired operating frequency of the apparatus 10.

The clamp ring 31, which has a thumb screw 33 and a nut 34, couples the tuning slide 28 to the bottom section 32. The bottom section 32 is preferably made of the same aluminum tubing as the tuning slide 28. The bottom section 32 is preferably covered by fiberglass insulation 35. Towards the rear of the bottom section 32 are two holes 36.

The handle assembly 40, (see FIGS. 2 and 4), comprises an insulated core 42 having a pair of threaded holes 43 and 44 at each end. The core 42 is sized to slide into the bottom section 32 so that the holes 36 align with the holes 43. A screw, not shown, is inserted through the aligned holes 36 and 43. Preferably, the core 42 has a diameter of about ⅝ inch. A copper coil 45 is wrapped around the core 42. At each end of the coil 45 is a copper mount 46. An insulated handle 49 is disposed over the core 42. A coaxial cable 47 connects the coil 45 to a female, coaxial cable connector 48. The connector 48 is coupled, by a mounting nut 50, to an end cap ring assembly 51. The ring assembly 51 has two threaded holes 52 for aligning with the holes 44. Two screws, not shown, are inserted through holes 44 and 51 thereby coupling the connector 48 to the core 42. An end cap 53 is slip fit over the connector 48. The end cap 53 has a dust cap 54 connected therewith by a chain 55 for protecting the connector 48 when the apparatus 10 is not coupled to the coaxial cable 70.

Figure 3:
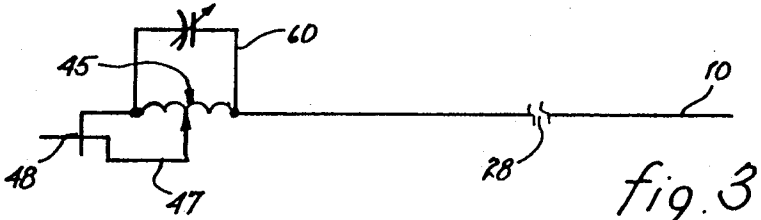
FIG. 3 is an electrical schematic of the dragstick/antenna of FIG. 1.

FIG. 3 is an electrical schematic of the apparatus 10. The coaxial cable connector 48 is electrically coupled via coaxial cable 47 to the coil 45. The signal flowing through the coil 45 is subjected to a variable capacitor 60 which matches the impedance of the two-way radio 72 to the impedance of the apparatus 10. The signal then travels through the bottom section 32 and then through the tuning slide 28 and out the tip section 22. For an operating frequency from about 130 megahertz to about 175 megahertz, (VHF), the length from the coil 45 to the spike 25 is about 35 inches, the coil 45 is wrapped about five times around the core 42, and the capacitor 60 is rated between 1–10 picofarads. For an operating frequency from about 410 megahertz to about 480 megahertz, (UHF), the length of the coil, the number of wrappings, and the rating of the capacitor are about half the values for VHF operation. Thus the length from the coil 45 to the spike 25 is about 17.5 inches, the coil 45 is wrapped about 2.5 times around the core 42, and the capacitor 60 is equivalent to less than 5 picofarads.

FIG. 5 illustrates the apparatus 10 in operation. First it is shown being used as a dragstick to make identifying marks along a trail. Then it is shown coupled to a two-way radio and being used as an antenna to broadcast and receive signals.

In the preferred embodiment, when broadcasting and receiving signals the apparatus 10 acts as a ½ wavelength, vertical omni-directional unity gain antenna. By grounding the apparatus 10 its gain can be increased by a factor of two.

Figures 6, 7, 8:
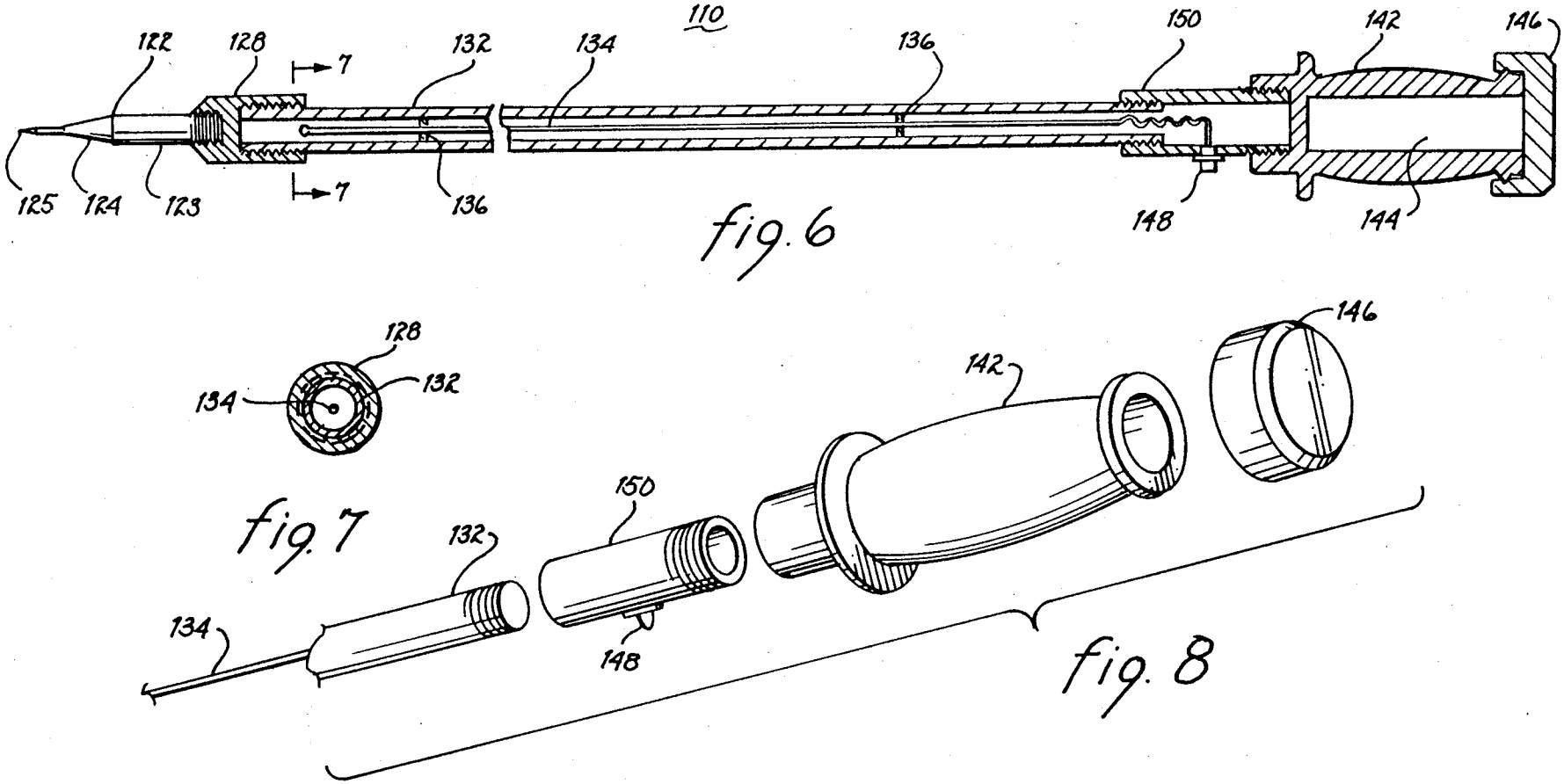
FIG. 6 is a cross-sectional view of an alternative embodiment of the dragstick/antenna of FIG. 1.
FIG. 7 is a cross-sectional view taken along line 7—7 of FIG. 6.
FIG. 8 is a partially exploded, perspective view of the dragstick/antenna of FIG. 6.

FIGS. 6–8 illustrate an alternative dragstick/antenna or apparatus 110 which can be coupled via a standard coaxial cable to a commercially available two-way radio 72. The apparatus 110 is comprised of an antenna assembly and a handle assembly.

The antenna assembly is comprised of a tip section 122, a tip coupler 128 and a shaft 132.

As in the preferred embodiment, the tip section 122 is made of metal. The tip section 122 has a cylindrical base 123 which is externally threaded at one end and has a tapered head 124 with a spike 125.

The shaft 132 is a hollow, substantially cylindrical, fiberglass shaft and is externally threaded at both ends. A copper wire 134 runs through the shaft 132. A plurality of grommet bushings 136 hold the wire 134 along the center of the shaft 132.

The tip coupler 128, is preferably made of aluminum, and is internally threaded at each end for screwably receiving the threaded ends of the tip section 122 and the shaft 132.

The handle assembly comprises a fiberglass grip 142 and a handle coupler 150. The grip 142 has a storage compartment 144 and a removable cap 146. One end of the grip 142 has an internal thread. The handle coupler 150, is preferably made of aluminum, and has an internal thread at one end for receiving an end of the shaft 132 and an external thread at the other end for coupling to the grip 142. A coaxial cable connector 148 is disposed through the surface of the handle coupler 150. The wire 134 is connected to the connector 148. The electrical circuitry for the apparatus 110 is the same as the electrical circuitry of the apparatus 10 and the apparatus 110 ca operate in the same frequency ranges as the apparatus 10.

While the invention has been described in its preferred embodiment, it is to be understood that the words which have been used are words of description rather than limitation and that changes may be made within the purview of the appended claims without departing from the true scope and spirit of the invention in its broader aspects.

I claim:

1. An apparatus for search and rescue signalling, comprising:

a rigid, tubular body of electrically insulating material having a first end and an opposite second end;

a handle assembly coupled to said first end of said tubular body; and sharp point means coupled to said second end of said tubular body for impressing distinct marks on the ground during search and rescue operations;

wherein the handle assembly comprises an electrically insulating handle grip and a tubular electrically conductive portion coupling said first end of said tubular body to said electrically insulating handle grip and wherein the tubular electrically conductive portion of the handle assembly includes a connector means for coupling a conductor to an external two-way radio;

said conductor extends from said connector means and extends through a portion of said tubular body; said conductor includes a coiled portion, said coiled portion of the conductor being surrounded by the tubular electrically conductive portion of the handle assembly and the portion of said conductor which extends through a portion of said tubular body forms an antenna; and wherein said antenna is the only electrically conductive material within said tubular body.

2. An apparatus for search and rescue signalling as in claim 1, further comprising spacer means for supporting said antenna conductor in spaced relation from an inner wall of said tubular body.

3. An apparatus for search and rescue signalling as in claim 2, wherein said spacer means comprises at least one grommet.

4. An apparatus for search and rescue signalling as in claim 1, wherein said handle grip has a hollow interior and said handle grip is provided with removable cap means for covering objects stored within said handle grip.

5. An apparatus for search and rescue signalling as in claim 1, wherein said sharp point means is made of metal.

6. An apparatus for search and rescue signalling as in claim 1, wherein said tubular body is made of fiberglass.

7. An apparatus for search and rescue signalling as in claim 1, wherein said handle grip is made of fiberglass.

8. An apparatus for search and rescue signalling as in claim 1, wherein said antenna operates as a half-wavelength, omni-directional unity gain antenna.

* * * * *